US009472130B2

(12) United States Patent
Sharpe et al.

(10) Patent No.: US 9,472,130 B2
(45) Date of Patent: Oct. 18, 2016

(54) FLAG SYSTEM

(71) Applicants: Gary Sharpe, Naples, FL (US); Lacey Fenner, Hilliard, OH (US)

(72) Inventors: Gary Sharpe, Naples, FL (US); Lacey Fenner, Hilliard, OH (US)

( * ) Notice: Subject to any disclaimer, the term of this patent is extended or adjusted under 35 U.S.C. 154(b) by 217 days.

(21) Appl. No.: 14/477,281

(22) Filed: Sep. 4, 2014

(65) Prior Publication Data

US 2015/0059639 A1 Mar. 5, 2015

Related U.S. Application Data

(60) Provisional application No. 61/873,511, filed on Sep. 4, 2013.

(51) Int. Cl.

| | |
|---|---|
| ***G09F 17/00*** | (2006.01) |
| ***G09F 15/00*** | (2006.01) |
| ***G09F 7/08*** | (2006.01) |
| ***G09F 7/14*** | (2006.01) |

(52) U.S. Cl.

CPC ..... *G09F 17/00* (2013.01); *G09F 7/08* (2013.01); *G09F 7/14* (2013.01); *G09F 15/005* (2013.01); *G09F 2017/0066* (2013.01)

(58) Field of Classification Search

CPC ..... G09F 7/22
USPC ..... 116/28 R, 173, 309–316
See application file for complete search history.

(56) References Cited

U.S. PATENT DOCUMENTS

| | | | | |
|---|---|---|---|---|
| 706,528 | A * | 8/1902 | Christian | G09F 7/00 116/316 |
| 2,706,352 | A * | 4/1955 | Clark | A63B 71/0672 40/492 |
| 3,315,634 | A * | 4/1967 | Sherrill | G09F 17/00 116/314 |
| 4,208,050 | A * | 6/1980 | Perrine | A63B 5/16 473/447 |
| 5,031,903 | A * | 7/1991 | Clarke | A63B 5/16 473/447 |
| 6,915,757 | B2 * | 7/2005 | Urban | B60Q 7/005 116/173 |
| 7,097,589 | B2 * | 8/2006 | Underwood | A63B 5/00 473/447 |
| D688,310 | S * | 8/2013 | Mauris | D20/18 |

FOREIGN PATENT DOCUMENTS

| | | | | |
|---|---|---|---|---|
| CA | 2406640 | A1 * | 11/2001 | G09F 11/02 |
| JP | 2000221893 | A * | 8/2000 | G09F 7/18 |

OTHER PUBLICATIONS

English translation of JP 2000221893 A.*

* cited by examiner

*Primary Examiner* — Daniel S Larkin
*Assistant Examiner* — Irving A Campbell
(74) *Attorney, Agent, or Firm* — Standley Law Group LLP

(57) ABSTRACT

A flag system having a modular construction is disclosed that includes a plurality of inserts and a plurality of flags. The flags are insertable through channels in the inserts and are able to rotate therein. The inserts are then slid into the open ends of channels in a channeled base that is fixed to a wall or other solid structure.

20 Claims, 8 Drawing Sheets

FLAG SYSTEM

CROSS-REFERENCE TO RELATED APPLICATIONS

This application claims priority to U.S. Provisional Application No. 61/873,511 filed 4 Sep. 2013, the content of which is hereby incorporated by reference as if fully recited herein.

TECHNICAL FIELD

Exemplary embodiments of the present invention relate generally to mechanical devices, namely flag systems. More particularly, the present invention relates to a modular flag system having movable flags that may be printed with identifying indicia.

BACKGROUND OF THE INVENTION

In the hospital, clinic and office settings rooms can be used for a variety of purposes. One method staff members have used to provide quick communication regarding the status of a room is the use of room flags. Room flags can be used to quickly inform both staff members and patients of what is going on in each room. For example, a staff member may look at the room flag and determine immediately whether the room is occupied or unoccupied, whether the room needs cleaning, what procedures the room is equipped to handle, the status of the patient in the room, or a variety of other information. The room flags serve a quick and efficient way to transmit information through a hospital, clinical or office setting.

Although traditional flag systems are adequate for communicating information regarding a room, traditional flag systems have several drawbacks. Traditional flag systems have a base that attaches to a wall or other solid feature, and a vertical bar. The flags on these systems are designed to fit over the bar and are designed to turn about their attachment to the bar. This design limits the number of flags that may be used. Additionally, it is difficult to remove or exchange the flags. To remove a flag it is necessary to use tools to loosen the bar from the base and then remove the flags from the bar. Then tools again must be used to replace the bar after the flags have been removed or exchanged. This process is both time consuming and difficult.

In still other traditional flag systems, the flags may be permanently attached to the base unit. This design necessitates the complete replacement of the unit if flags need to be replaced or exchanged. This results in increased expense and the removal and installation of a new flag system is both difficult and time consuming, typically requiring maintenance staff to perform the task.

In addition, both traditional designs are limited to the number of flags that can be used. The units are purchased with a predefined number of flags that cannot be increased without the purchase of another unit. With traditional flag systems there is no easy solution for expansion with respect to the number of flags.

Consequently, there is a need for a flag system having a modular design that would allow easy replacement and removal of the flags without the need for tools and provides the ability to expand the unit for use with additional flags. No known references, taken alone or in combination, are seen as teaching or suggesting the presently claimed flag system.

BRIEF SUMMARY OF THE INVENTION

Accordingly, exemplary embodiments of the present invention have been made to remedy the previously mentioned problems and provide an advantageous flag device. The modular nature of the inventive flag system allows for easy installation of flags and likewise allows for easy removal and replacement of the flags due to a change in color coding or breakage.

The flag system includes three distinct parts that are joined together without tools to form the flag system. The flag system has a channeled base for receiving and holding a number of inserts, each insert having a flag inserted therein. The channeled base has a rectangular body having spaced apart channels running its length. An optional end cap may be provided at an end of the channeled base to prevent the inserts from sliding out. A ridge is provided along the center-line of the channeled base to assist in correctly positioning the inserts therein and to make sure the flag remains properly seated in the inserts. In other exemplary embodiment of the flag system, the ridge on the channeled base is unnecessary and may be eliminated. Apertures acting as attachment points may also be provided in the channeled base allowing mechanical fasteners to be used to fix the channeled base to a wall or other structure. However, the channeled base may also be affixed to a wall with adhesive or magnets eliminating the need for mechanical fasteners.

The inserts of the flag system have a U-shaped body having a plate and arms extending therefrom. A slot is provided in the plate and extends into both arms and is adapted to receive a flag. The arms have raised pads to prevent the accidental movement of the flag within the insert. The plate of the insert has protrusions extending therefrom; the protrusions are designed to be indexed in the channels of the channeled base. In other exemplary embodiment of the inserts two pairs of projections may be present in the portion of the slot residing in the first and second arms. The projections form a pocket at the end of the slot to receive the tabs found on the flags. In this manner the tabs can be snapped into the pockets preventing the flag from sliding out of the insert.

The flags of the inventive flag system may have an elongated body having a rounded tip. Opposite the rounded tip the flag has a pair of tabs extending therefrom. The tabs are designed to nest in the slot in the inserts and allow the flag to be rotated therein. To install the flag, the flag is simply inserted into the slot of the insert, starting with the end of the flag opposite the tabs. The flag is passed through the insert until the tabs are nested in the slot preventing the flag from being passed completely through the insert.

Once the flag is positioned within the insert, the insert is then slid into the channeled base. The protrusions are aligned with the channels in the channeled base and indexed therein. Additional flags may be added in the same manner. If the channeled base is not large enough to accommodate the number of desired flags an additional channeled base may be used. This additional channeled base would not include the optional end cap and would be mated with the already affixed base. This would allow an insert/flag assembly to be slid through the expansion channeled base into the original channeled base.

It is an object of this invention to provide a flag system of the type generally described herein, being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
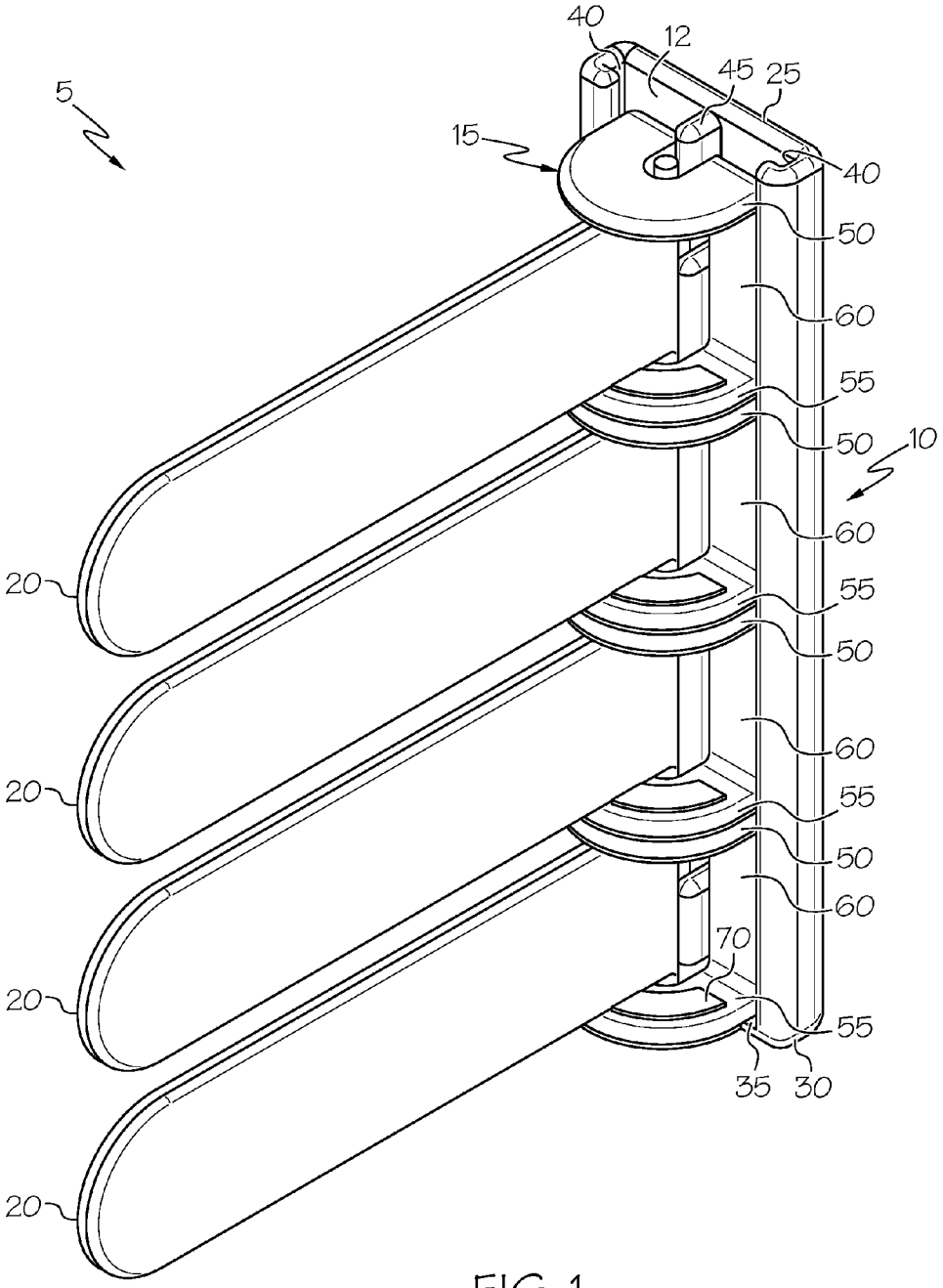
FIG. 1 is a perspective view of an exemplary embodiment of a flag system with flags positioned perpendicular to the channeled base.

Exemplary embodiments of the present invention will now be described in greater detail. It should be recognized that the present invention can be practiced in a wide range of other embodiments besides those explicitly described, and the scope of the exemplary embodiments described are expressly not limited.

Directing attention to the drawings and particularly to FIGS. 1-4 wherein each figure provides a different view of an exemplary flag system 5, and FIGS. 5-9 wherein certain elements of the exemplary embodiment flag system 5 are shown. As best illustrated in FIGS. 1-4, the flag system 5 is formed by the combination of modular components, including: a channeled base 10, one or more inserts 15 and a corresponding number of flags 20 according to the inventive concept. Although described in more detail below with respect to FIG. 5, the channeled base 10 has an elongated body having a longitudinal axis and a substantially rectangular shape. The channeled base 10 has a first, open end 25 allowing the inserts 15 to be slid into the channeled base 10. The channeled base 10 is shown with an optional end cap 35 at a second end 30 opposite the first end 25. The end cap 35 prevents the inserts 15 from falling out of the channeled base 10 when the base 10 is affixed vertically to a wall or other solid support or surface. It should be understood, that the channeled base 10 may not have an end cap 35 allowing inserts 15 to be slid into the channeled base 10 from either the first 25 or second 30 ends. Although shown having the capacity for four flags it should be understood that the length of the channeled base 10 could be adjusted to accommodate any number of flags, or the size of the flags and inserts may be likewise reduced in order to fit more flags onto a base of any particular size.

The channeled base 10 has symmetrical channels 40 rising from its longitudinal edges and the channels 40 are arranged parallel to the longitudinal axis of the base 10. The channels 40 run from the first end 25 of the base 10 and terminate at the end cap 35, or alternatively, at the second end 30 of the base 10 if no end cap 35 or other similar stop is utilized. The channels 40 assist in securing the inserts 15 within the channeled base 10.

A ridge 45 is also provided along the center-line of the base 10. The ridge 45 extends outwardly from the front face 12 base 10 in the same direction as the channels 40 and runs substantially the length of the channeled base 10. The ridge 45 feature will be discussed in more detail with respect to FIG. 5.

Figure 2:
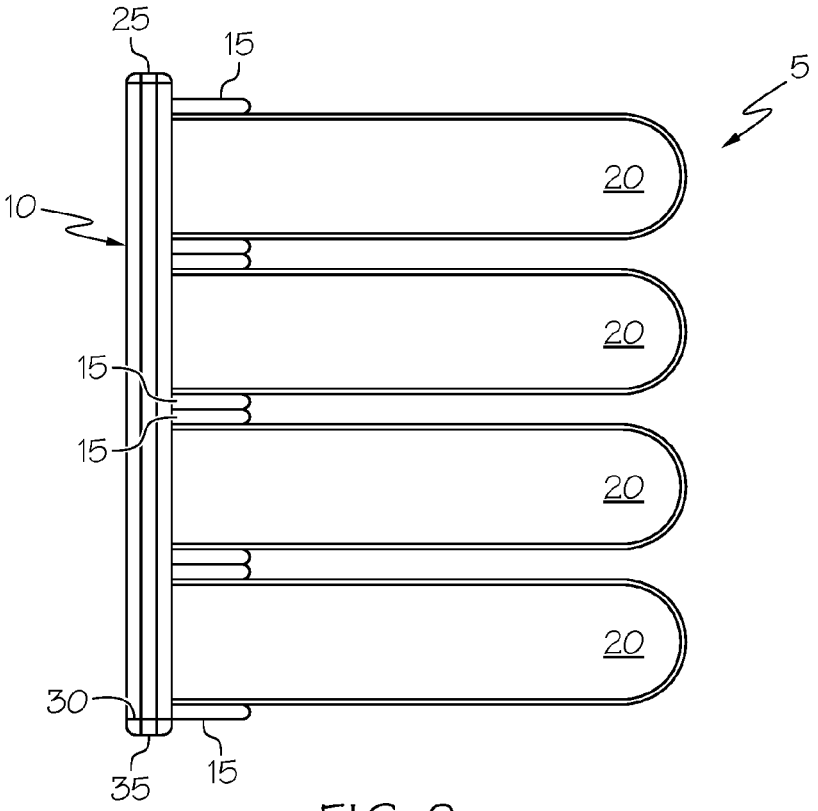
FIG. 2 is a side view of the exemplary flag system of FIG. 1.
Figure 3:
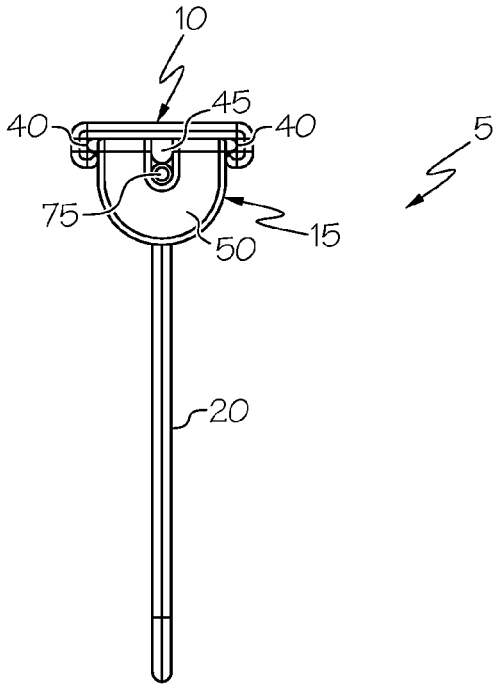
FIG. 3 is a top view of the exemplary flag system of FIG. 1.

As illustrated in FIGS. 1 and 2, the flag system 5 includes a number of inserts 15 slid into the channeled base 10 from the first end 25. The inserts 15 are a U-shape having opposing, symmetrical first 50 and second 55 arms joined together by a plate 60. A slot 65 is provided in plate 60 and extends into both the first 50 and second 55 arms. The slot 65 is designed to accept and allow the passage of a flag 20 and allow the ridge 45 to rest therein. The interior facing surfaces of the first 50 and second 55 arms may have raised pads 70 thereon. These and additional features of the inserts 15 will be discussed with respect to FIGS. 6 and 7.

As shown in FIGS. 1-4, the flag system 5 also includes a plurality of flags 20. The flags 20 have a thin, elongate body 20 and tabs 75 extending outwardly from an attachment edge 22 thereof. The flag 20 is placed into inserts 15 by passing the flag 20 through the slot 65 until the tabs 75 become nested in the slot 65 preventing the complete passage of the flag 20 through the insert 15. The flags 20 can be color coded and/or have indicia printed thereon. To maintain the flags 20 in an "in use" arrangement, where the flag 20 extends perpendicular from the channeled base 10 (as shown in FIGS. 1-4), the flag 20 is registered between raised pads 70 on both the first 50 and second 55 arms of the insert 15. The flag 20 is shown in more detail in FIG. 8.

Figure 4:
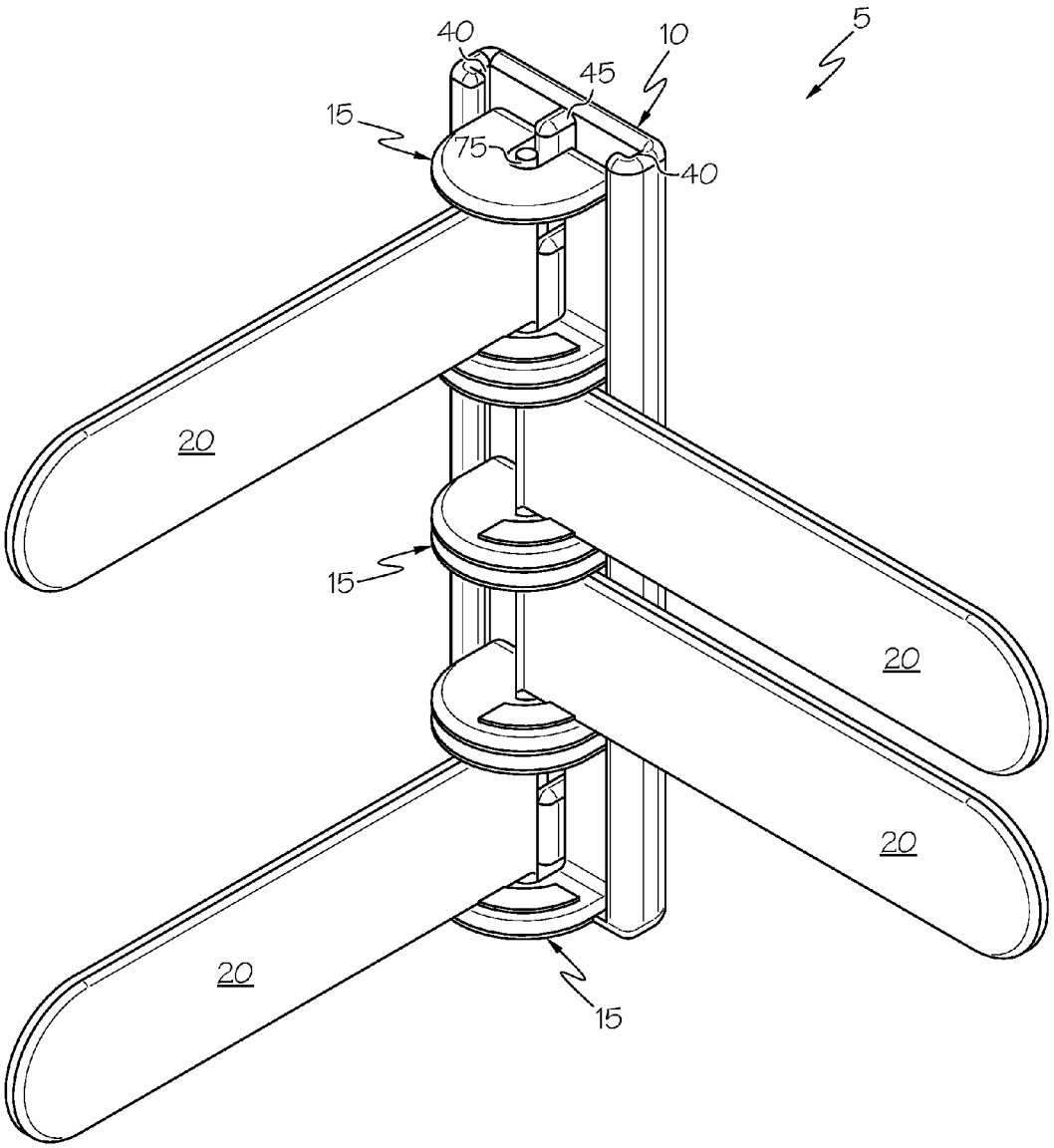
FIG. 4 is a top perspective view of the exemplary flag system of FIG. 1 wherein two flags are positioned perpendicular to the channeled base and two flags are positioned parallel to the channeled base.

FIG. 4 is a perspective view of the flag system 5 having two flags 20 in the extended or "in use" position and two flags 20 not in use or the non-extended position. As stated above the extended flags 20 are maintained in place by being registered between the raised pads 70 on the first 50 and second 55 arms of the insert 15. The non-extended flags 20 are maintained in their position by at least one of the raised pads 70 on the first 50 or second 55 arms. The flags 20 can be moved into the non-extended position to either side of the flag system 5, in this embodiment for instance naturally occupying a position at 0°, 90° or 180° with respect to the front face 12 of the channeled base 10. As should be understood, the use of the raised pads 70 provides a lateral restraining force against one or both faces of the flag to prevent the accidental, premature or otherwise unwanted rotational movement of the flags 20. When the flags 20 are moved over the raised pads 70, the first 50 and second 55 arms of the inserts 15 are forced apart slightly; the resultant force on the flags 20 temporarily secures and prevents the accidental movement of the flags 20. Alternatively or in combination, the inserts may be configured as substantially rigid bodies wherein the raised pads 70 are compressible, and therefore forced to compressed when a sufficient moment is applied to the flag.

Figure 5:
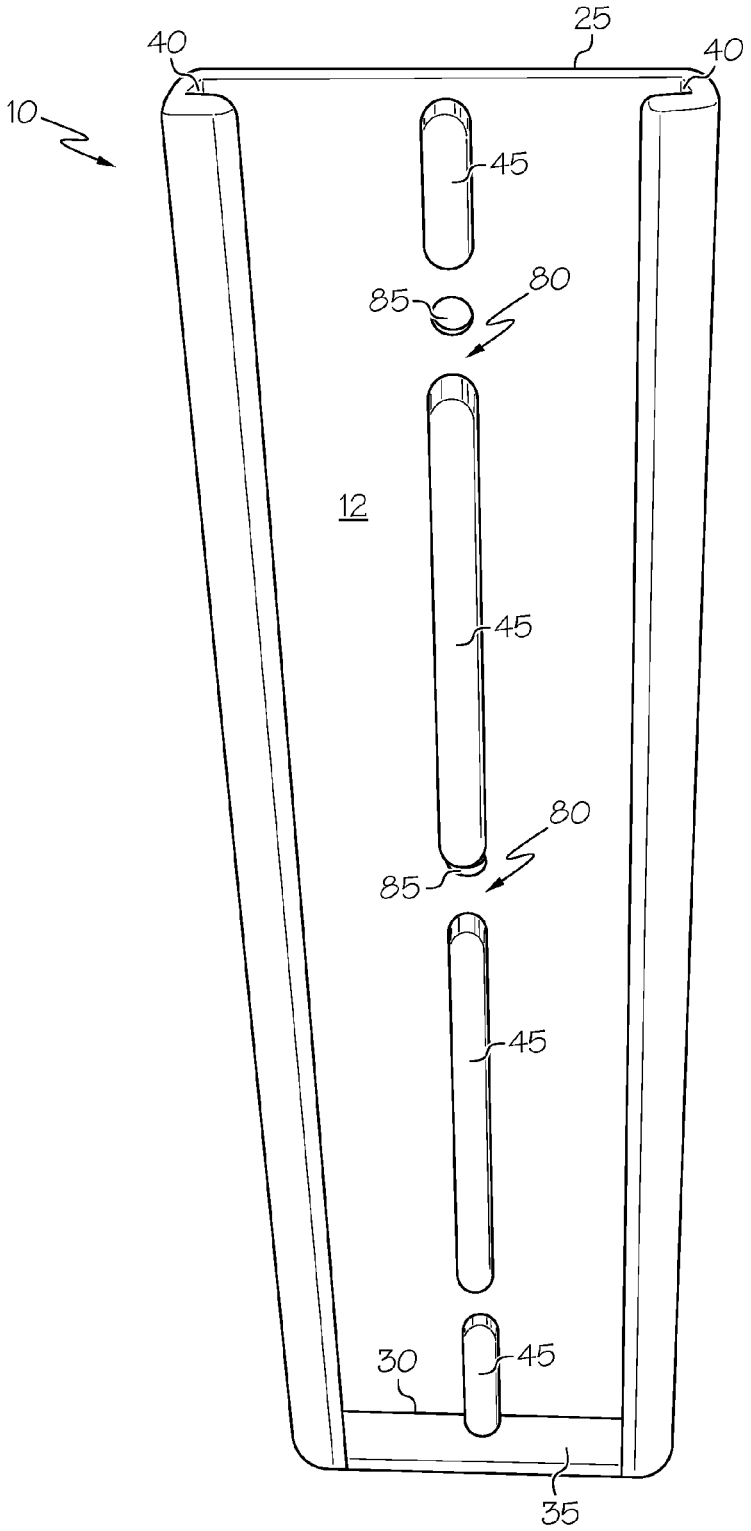
FIG. 5 is a perspective view of a channeled base used in the exemplary flag system of FIG. 1.

FIG. 5 is a perspective view of the channeled base 10. As described above, the channeled base 10 has a first end 25 and a second end 30. An end cap 35 is provided at the second end 35 preventing the inserts 15 from falling out of the channeled base 10. Channels 40 are provided along the longitudinal edges of the channeled base 10. A ridge 45 is also provided along the center-line of the base 10. As illustrated in FIG. 5, the ridge 45 may have breaks 80 therein to accommodate attachment points 85 for mechanical fasteners (not shown). The attachment points 85 are simply apertures in the base 10 that would allow a mechanical fastener to be used to fix the base 10 to a wall or other solid support. In other exemplary embodiments, the breaks 80 may be unnecessary as the attachment points 80 may be moved away from the center-line of the base 10 may extend through the ridge 45. In these embodiments the ridge 45 would run continuously along the base 10 without breaks 80 therein. In still other embodiments, an aperture and mechanical fastener such as a set screw (see FIG. 10) may be placed at the first end 25 of the base 10. The aperture is configured such that the mechanical fastener is secured to the aperture after the inserts with flags have been placed in the channeled base. The aperture and mechanical fastener are configured to prevent the inserts from falling out of the top of the base 10. A similar, removable fastener may be optionally provided at the second end 30 of the base in lieu of a cap 35, for instance. It will understood that the channeled base may thus be provided with channels having two open ends or one open end and one closed end.

Figure 6:
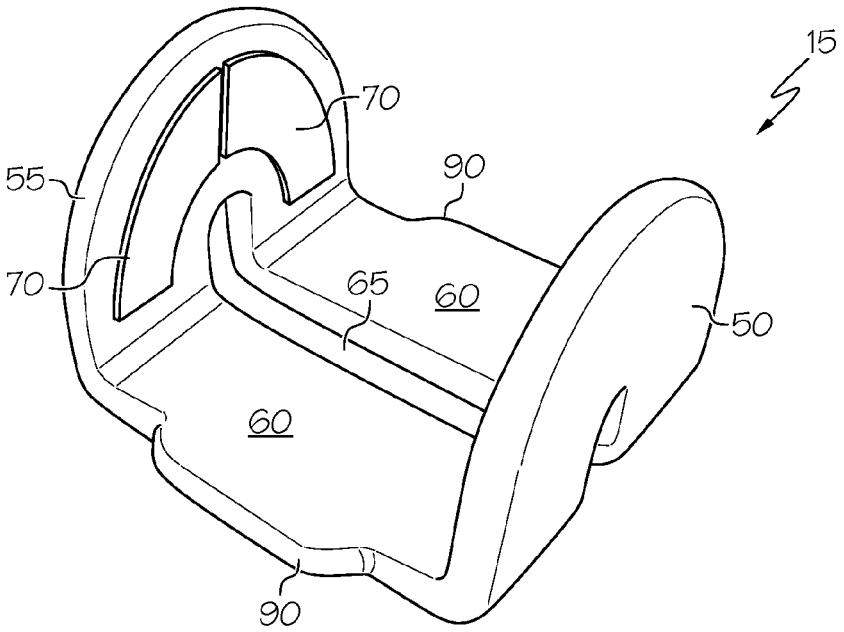
FIG. 6 is a side perspective view of an insert used in the exemplary flag system of FIG. 1.

FIG. 6 is a side perspective view of an insert 15. As described above, the insert 15 has a U-shaped body having first 50 and second 55 side arms joined together by a plate 60. A slot 65 is provided in the plate 60 and extends into the first 50 and second 55 arms. The interior surfaces of the first 50 and second 55 arms have raised pads 70 thereon. As illustrated, each arm 50, 55 has raised pads 70 thereon. The raised pads 70 do not meet along the center line (i.e., corresponding to the extended, or 90° flag position) of the first 50 and second 55 arms allowing the flag 20 to be registered therein when in the extended position. In addition, raised pads 70 do not extend all the way to the plate 60 providing a nesting position for the flags 20 when in the non-extended position. This configuration prevents the accidental movement of the flags 20 from the extended position to the non-extended position and the accidental movement of the flags 20 from the non-extended position to the extended position. If desired, the raised pads 70 may be provided with more than three positions, for example by providing breaks at 45 degree angles with respect to the plate 60, thereby separating the raised pads 70 into four discrete sections and providing five flag positions. Furthermore, in some exemplary embodiments, raised pads 70 are provided on only one of the first 50 and second 55 arms.

Additionally, FIG. 6 illustrates a pair of protrusions 90 extending from either side of the plate 60. The protrusions 90 are positioned for insertion into open ends of the channels 40. This indexing of the protrusions 90 into the channels 40 prevents the inserts 15 from falling out of the channels 40. To place the inserts 15 into the channeled base 10, the protrusions 90 are lined up with the channels 40 and the inserts 15 are slid into the channeled base 10, with the protrusions 90 residing in the channels 40.

Figure 7:
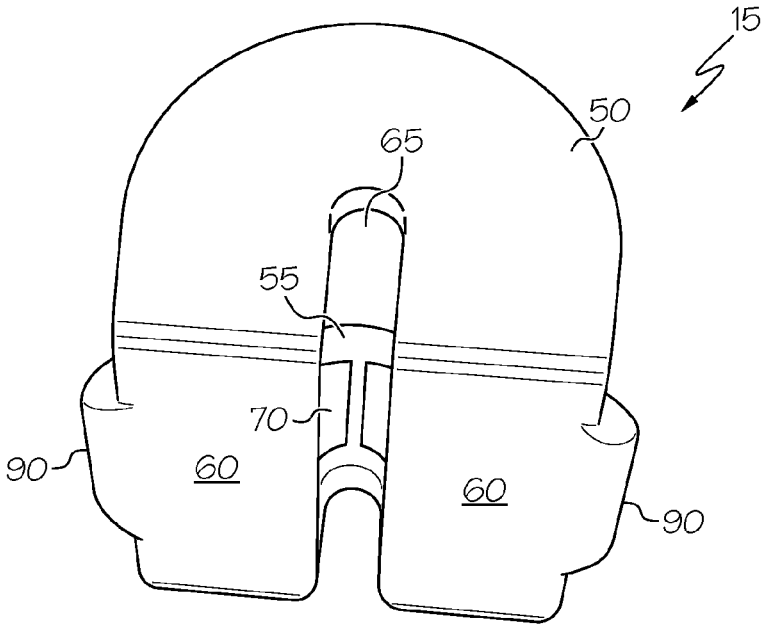
FIG. 7 is a rear perspective view of an insert used in the exemplary flag system of FIG. 1.
Figure 8:
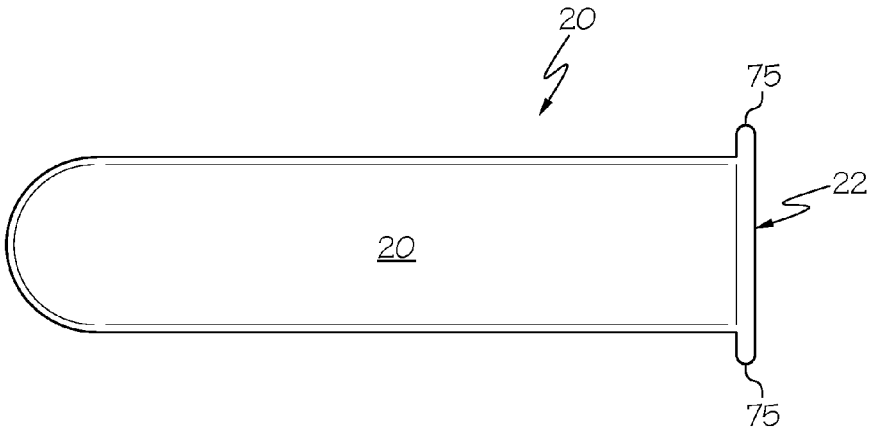
FIG. 8 is a side view of a flag used in the exemplary flag system of FIG. 1.

FIG. 7 provides another view of the inserts 15. This rear perspective view of the inserts 15 clearly illustrates the slot 65 as it passes through the plate 60 and extends into a portion of the first 50 and second 55 arms. As described above, the slot 65 accepts a flag 20, allowing the flag 20 to pass there through until the tabs 75 prevent further movement. The flag 20 is then able to rotate about the tabs 75 so as to be placed in the extended or non-extended positions.

Figure 9:
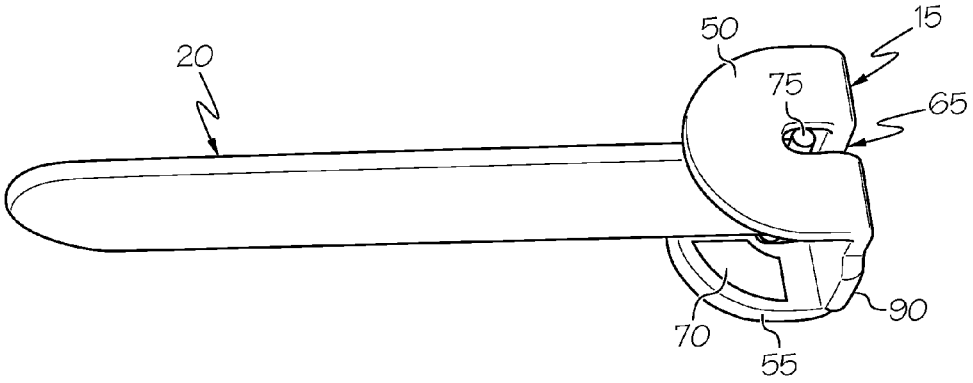
FIG. 9 is a top perspective view of a flag joined with an insert to form a flag assembly as used in the flag system of FIG. 1.

FIG. 9 is a perspective view of a flag 20 residing in the slot 65 of an insert 15 an extended position. A side view of the flag 20 is shown in connection with FIG. 8. As shown, the flag 20 had been passed though the slot 65 until the tabs 75 are nested in the slot 65. The flag 20 can now be rotated approximately 180° about the axis extending through the tabs 75. Once the flag 20 has been placed in the insert 15 as shown in FIG. 9, the insert 15 may be placed in the channeled base 10 as shown in FIGS. 1-4. Although the flag 20 is shown with an elongated body having a rounded tip, one of skill in the art should understand that the flag 20 could have a variety of shapes and sizes, as long as the body of the flag 20 would fit through the slot 65 or between the first 50 and second 55 arms. In addition, the flag 20 could be a variety of colors specific to the color codes of the hospital, clinic, or office in which it is used. Indicia or words may also or alternatively be printed on the flags 20.

It should be understood from the description of the inventive flag system 5 that easy assembly and replacement of flags 20 is provided. To assemble the flag system 5 one need only pass a flag 20 through the slot 65 on an insert 15 until the tabs 75 are nested in the slot 65; as illustrated in FIG. 9. The flag assembly of the flag 20 and insert 15 is then slid into the channeled base 10 at the first end 25, with the protrusions 90 on the insert 15 indexed in the channels 40. This assembly process is repeated for each flag 20 desired to be added to the flag system 5. To replace a flag 20 due to a change coding or breakage, the process is simply repeated. The insert 15 is slid up and out of the channeled base 10, and the flag 20 is removed from the slot 65 in the insert 15. Once the flag 20 is removed simply assemble the flag system 5 again. In embodiments configured with a means for capping the open end after the installations of the flag assemblies, the additional steps of activating and deactivating the means for capping the open end would be necessary as well. For example, in embodiments where a set screw is used to prevent the insert from sliding out the open end, the set screw would be removed before removing and disassembling the flag assemblies.

It should also be understood that the modular features of the inventive flag system 5 allows for easy expansion of the flag system 5. To expand the flag system 5 to accommodate more flags 20, an additional channeled base 10 could be added. The expansion channeled base 10 would not include the optional end cap 35. The additional channeled base 10 would then simply be fixed to the wall and mated with the first end 25 of the already affixed channeled base 10.

Figure 10:
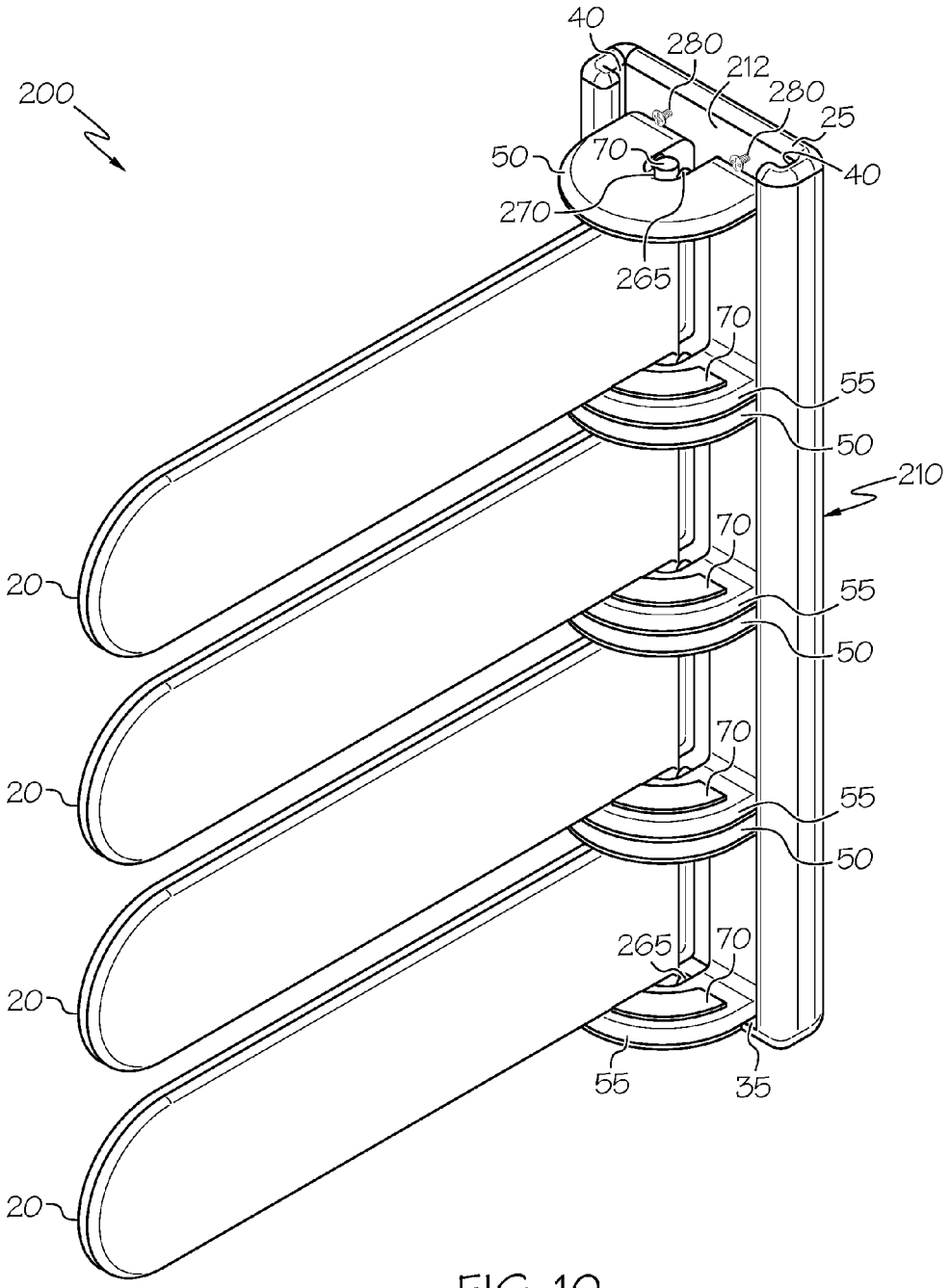
FIG. 10 is a top perspective view of a second exemplary embodiment of a flag system with flags positioned perpendicular to the base.
Figure 11:
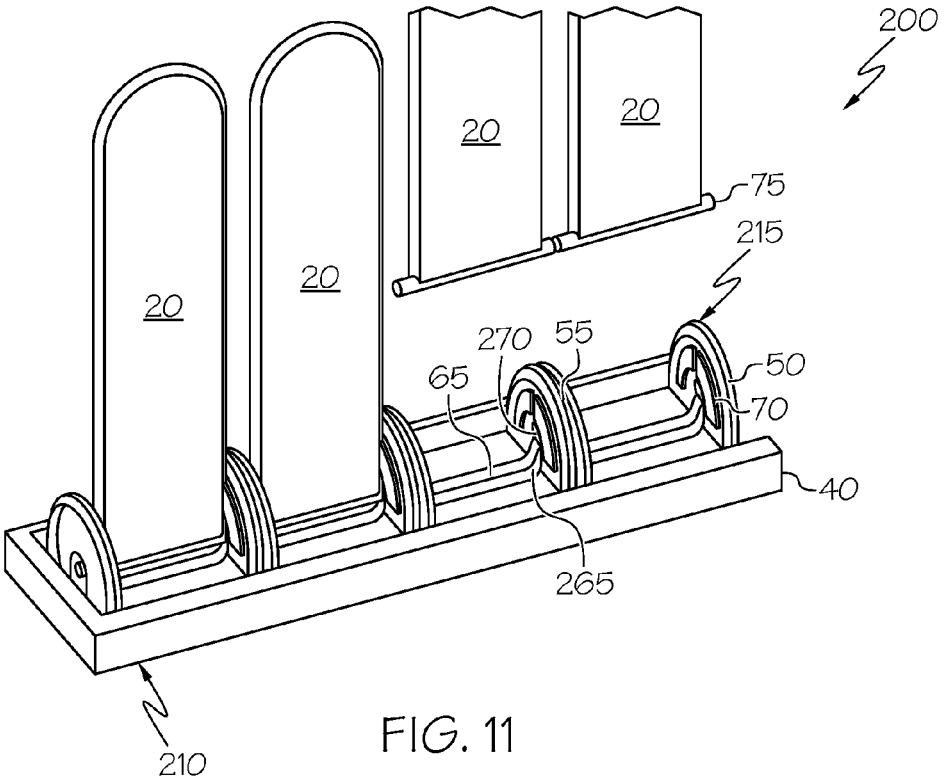
FIG. 11 is an exploded partial view of the flag system of FIG. 10.

FIGS. 10-11 illustrate another embodiment of the flag system 200 according to the inventive concept. As will be noted, although some features differ with respect to the flag system embodiment 5 described in connection with FIGS. 1-4, both embodiments retain the modular nature of the invention. As with previous embodiments, the flag system 200 is formed by modular components that include: a channeled base 210, inserts 215, and flags 20. The channeled base 210 has an elongated body having a longitudinal axis and a substantially rectangular shape. As with the prior channeled base 10, this channeled base 210 includes first 25 and second 30 end and an optional end cap 35 positioned at the second end 30. Symmetrical channels 40 are also provided along the longitudinal edges of the base 210. However, as will be noticed in FIG. 10, this embodiment of the channeled base 210 does not include a ridge (e.g., 45 in FIG. 5) along its center-line. The insert 215 used in this embodiment of the flag system 200 eliminates the need for the ridge 45 present in the other flag system embodiment 5.

Also shown in the embodiment depicted in FIGS. 10-11 is the optional use of one or more set screws 280 configured to protrude perpendicularly to the front face 212 of the channeled base 210 when inserted into apertures (not shown) therein. This exemplary means of capping the open end 25 of the channeled base 210 prevents the removal of the inserts 215 from the channeled base 210 by preventing the inserts 215 from moving past the set screws 280, until they are removed from the channeled base 210. In this manner, the accidental removal flag assemblies from the channeled base, or removal due to undesirable tampering, may be prevented or otherwise reduced.

As with the previous insert 15 embodiment, this insert 215 has a U-shape, having first 50 and second 55 arms joined together by a plate 60. A slot 65 is provided in the plate 60 and extends into both the first 50 and second 55 arms. The slot 65 allows the insertion and passage of a flag 20. As with the previous design, the insert 215 has raised pads 70 on the interior facing surfaces of one or both the first 50 and second 55 arms. The difference between insert 215 and the previous insert 15 is the inclusion of projections 265 within the slot 65. A pair of projections 265 is present in the portion of the slot 65 residing in the first arm 50 and another pair of projections 265 is present in the portion of the slot 65 residing in the second arm 55 of the insert 215. The projections 265 serve to hold the flag 20 within the slot 65, while still allowing rotation of the flag 20. All other features are substantially identical between the two embodiments of the flag system 5, 200.

Figure 12:
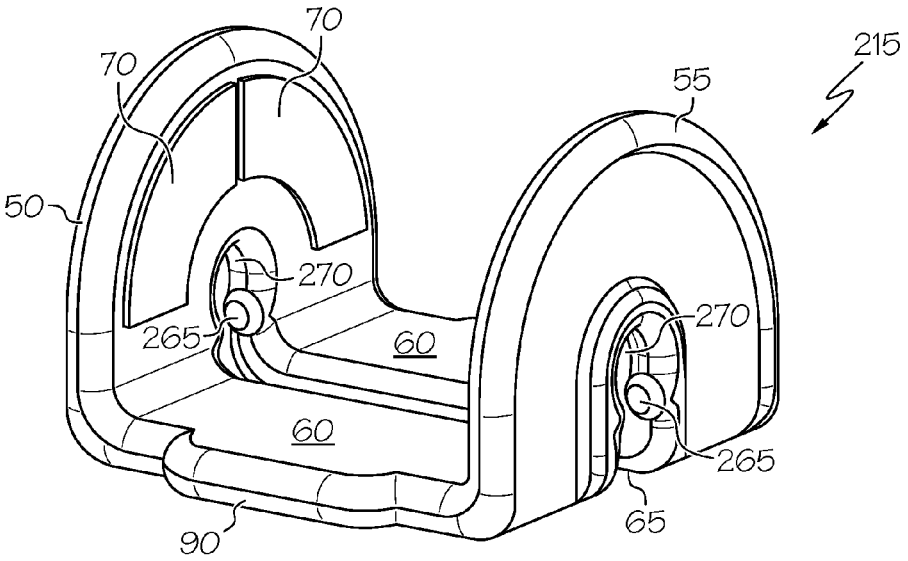
FIG. 12 is a top perspective view of an insert used in the exemplary flag system of FIG. 10.

FIG. 12 is a top perspective view of an insert 215 used with an exemplary embodiment of the flag system 200. As described above, the insert 215 has a first 50 and second 55 arm connected by a plate 60. A slot 65 is present in the plate 60 and extends into both arms 50 and 55. One or both of the interior faces of the arms 50 and 55 have raised pads 70 thereon securing and preventing accidental movement of the flags 20 therein. As mentioned, a pair of projections 265 is provided in the slot 65 on both the first 50 and second 55 arms. The projections 265 form a pocket 270 at either end of the slot 65. Once a flag 20 is fully inserted into the insert 215 the tabs 75 are nested in the pockets 270. The projections 265 and pockets 270 prevent the flag 20 from slipping out of the slot 65, while still allowing rotation of the flag 20. The clearance between opposing projections 265 in a pair of projections may be such that the tabs 75 must be forced through in such a manner that the flags 20 "snap" into position in the pockets 270 when fully inserted. This embodiment of the insert 215 differs from the previous 15 because a ridge is not needed to retain the tabs 75 securely within the slot 65.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A modular flag apparatus comprising:
- a channeled base comprising:
  - two longitudinal edges in parallel to each other;
  - a first end and a second end, together defining the ends of the two longitudinal edges;
  - two channels, each extending along one of the two longitudinal edges of the channeled base and each having two open ends, and wherein the two channels are symmetrical about a plane of symmetry; and
  - a front face; and
  - a back face;
- an insert removably retained in the channeled base comprising:
  - a plate having a pair of ends defining a length and a pair of sides defining a width;
  - an arm extending from each end in the pair of ends thereby forming a pair of arms;
  - a slot extending through the length of the plate and into a portion of each arm in the pair of arms; and
  - a protrusion extending from each side in the pair of sides, each protrusion adapted for registration within one of the two channels of the channeled base; and
- a flag retained by the insert, the flag comprising:
  - a body having an attachment edge, wherein the body is sized to fit between the pair of arms; and
  - a pair of tabs extending from opposing ends of the attachment edge and configured to be retained within the slot of the insert.

2. The apparatus of claim 1, wherein the channeled base further comprises:
- a ridge extending from the front face of the channeled base whereby the ridge registers within the slot of the insert.

3. The apparatus of claim 2, wherein the ridge is coincident with the plane of symmetry of the two channels.

4. The apparatus of claim 3, wherein the ridge extends continuously from the first end of the channeled base to the second end of the channeled base.

5. The apparatus of claim 4, wherein the two channels of the channeled base each have an open end positioned at the first end of the channeled base and a closed end positioned at the second end of the channeled base.

6. The apparatus of claim 5, wherein the channeled base further comprises:
- an aperture in the ridge at the first end of the channeled base; and
- a removable set screw retained within the aperture, thereby maintaining the insert within the channeled base.

7. The apparatus of claim 3, wherein the channeled base further comprises:
- at least one attachment point comprising an aperture adapted for accommodating a mechanical fastener therein to secure the channeled base to a surface.

8. The apparatus of claim 3, wherein the channeled base further comprises:
- an adhesive applied to the back surface whereby the channeled base is securable to a surface.

9. The apparatus of claim 1, wherein an arm of the insert further comprises:

a plurality of raised pads on an interior surface of the arm.

10. The apparatus of claim 1, wherein the two channels of the channeled base each have an open end positioned at the first end of the channeled base and a closed end positioned at the second end of the channeled base.

11. The apparatus of claim 10, wherein the channeled base further comprises:

an aperture in the front face at the first end of the channeled base; and a removable set screw retained within the aperture, thereby maintaining the insert within the channeled base.

12. The apparatus of claim 1, wherein the channeled base further comprises:

an end cap positioned along the second end of the channeled base whereby one end of each of the two channels of the channeled base is closed.

13. The apparatus of claim 1, wherein the slot of the insert further comprises:

a set of projections defining a pocket corresponding to each tab in the pair of tabs and adapted to retain the pair of tabs within the pocket.

14. A modular flag apparatus comprising:

a channeled base comprising:

two longitudinal edges in parallel to each other;

two channels, each extending along one of the two longitudinal edges of the channeled base and each comprising:

an open end positioned at the first end of the channeled base; and a closed end positioned at the second end of the channeled base, wherein the two channels are symmetrical about a plane of symmetry; and a front face;

a back face; and a means for securing the channeled base to a surface;

an insert removably retained in the channeled base comprising:

a plate having a pair of ends defining a length and a pair of sides defining a width;

an arm extending from each end in the pair of ends thereby forming a pair of arms;

a slot extending through the length of the plate and into a portion of each arm in the pair of arms; and a protrusion extending from each side in the pair of sides, each protrusion adapted for registration within one of the two channels of the channeled base whereby the insert is retained in the channeled base; and a flag retained by the insert, the flag comprising:

a body having an attachment edge, wherein the body is sized to fit between the pair of arms; and a pair of tabs extending from opposing ends of the attachment edge and configured to be retained within the slot of the insert.

15. The apparatus of claim 14, wherein the channeled base further comprises:

a ridge extending from the front face of the channeled base whereby the ridge registers within the slot of the insert.

16. The apparatus of claim 15, wherein the ridge extends continuously from the first end of the channeled base to the second end of the channeled base.

17. The apparatus of claim 14, wherein the channeled base further comprises:

a means for reversibly capping the first end of the channeled base.

18. The apparatus of claim 14, wherein an arm of the insert further comprises:

a plurality of raised pads on an interior surface of the arm.

19. The apparatus of claim 14, wherein the insert further comprises:

two raised pads on an interior surface of each arm in the pair of arms, configured to define three flag positions.

20. The apparatus of claim 19, wherein the three flag positions are 0°, 90° and 180° relative to the front face of the channeled base.

* * * * *